US012653281B2

(12) United States Patent
Peterson et al.

(10) Patent No.: US 12,653,281 B2
(45) Date of Patent: Jun. 16, 2026

(54) POLE GRIP

(71) Applicant: Black Diamond Equipment, Ltd., Salt Lake City, UT (US)

(72) Inventors: Kenneth Peterson, Sandy, UT (US); Lucy Davis, Salt Lake City, UT (US); Jonathan Cohen, Salt Lake City, UT (US); Brennan Wade, Sandy, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 260 days.

(21) Appl. No.: 18/373,069

(22) Filed: Sep. 26, 2023

(65) Prior Publication Data

US 2024/0108107 A1 Apr. 4, 2024

Related U.S. Application Data

(60) Provisional application No. 63/412,203, filed on Sep. 30, 2022.

(51) Int. Cl.
*A45B 9/02* (2006.01)
*A63C 11/22* (2006.01)

(52) U.S. Cl.
CPC ..... *A45B 9/02* (2013.01); *A63C 11/222* (2013.01); *A45B 2009/025* (2013.01)

(58) Field of Classification Search
CPC ..... A63C 11/2224; A63C 11/2228; A63C 11/222; A45B 9/02; A45B 2009/025
USPC ..... 280/822
See application file for complete search history.

(56) References Cited

U.S. PATENT DOCUMENTS

| | | | | |
|---|---|---|---|---|
| 3,232,632 | A | 2/1966 | Lewis | |
| 3,378,273 | A | 4/1968 | Lewis et al. | |
| 5,549,330 | A | 8/1996 | Wells | |
| 6,264,242 | B1 | 7/2001 | Lenhart | |
| 7,226,084 | B2 * | 6/2007 | Lenhart | A63C 11/2224 280/821 |
| 7,621,564 | B2 * | 11/2009 | Lenhart | A45B 9/02 280/821 |
| 7,661,713 | B2 * | 2/2010 | Panizza | A63C 11/2224 280/821 |

(Continued)

FOREIGN PATENT DOCUMENTS

| | | |
|---|---|---|
| CA | 2911899 | 3/2023 |
| CN | 203105900 U | 8/2013 |

(Continued)

OTHER PUBLICATIONS

European Patent Application No. 23200332.7 - Extended European Search Report dated Jul. 1, 2024.

*Primary Examiner* — James A Shriver, II
*Assistant Examiner* — Hilary L Johns
(74) *Attorney, Agent, or Firm* — Kane Kessler, P.C.; Paul E. Szabo

(57) ABSTRACT

A trekking pole or the like includes a grip top fixed at the top end. A user's glove supports a puck. The puck is placed on a release button then slid into a locking channel on the grip top, from the release button into the locking channel. Thereafter, the release button automatically locks the puck in the channel. When the release button is pressed down, the puck can be removed. A magnet on the release button can assist in locating the puck properly on the release button and also in withdrawing the puck from the locking channel.

6 Claims, 7 Drawing Sheets

(56) References Cited

U.S. PATENT DOCUMENTS

| | | | | |
|---|---|---|---|---|
| 7,770,931 | B2 * | 8/2010 | Lenhart | A63C 11/2224 280/821 |
| 7,891,708 | B2 * | 2/2011 | Panizza | A63C 11/2224 280/821 |
| 8,079,617 | B2 * | 12/2011 | Lenhart | A45B 9/02 280/821 |
| 8,579,329 | B2 * | 11/2013 | Lenhart | A63C 11/2224 280/821 |
| 8,714,172 | B2 * | 5/2014 | Heim | A45B 9/02 135/65 |
| 8,850,670 | B2 | 10/2014 | Fiedler | |
| 9,027,206 | B2 * | 5/2015 | Guyoton | B25G 1/00 16/114.1 |
| 9,168,448 | B2 | 10/2015 | Donnadieu et al. | |
| 9,526,974 | B2 | 12/2016 | Bennert et al. | |
| 10,064,463 | B2 * | 9/2018 | Kreis | A45B 9/02 |
| 11,325,019 | B2 | 5/2022 | Heim et al. | |
| 11,331,560 | B2 * | 5/2022 | Heim | A63C 11/2224 |
| 11,524,221 | B2 | 12/2022 | Bernocci | |
| 2005/0225070 | A1 * | 10/2005 | Lenhart | A63C 11/2224 280/821 |
| 2009/0250917 | A1 * | 10/2009 | Lenhart | A45B 9/02 280/821 |
| 2014/0165336 | A1 * | 6/2014 | Guyoton | A45B 9/02 16/430 |
| 2022/0258031 | A1 | 8/2022 | Marks et al. | |
| 2024/0108107 | A1 * | 4/2024 | Peterson | A45B 9/02 |

FOREIGN PATENT DOCUMENTS

| | | | |
|---|---|---|---|
| DE | 2656814 | A1 | 6/1978 |
| DE | 202017100469 | | 3/2017 |
| EP | 0357517 | A1 | 3/1990 |
| EP | 0370900 | A1 | 5/1990 |
| EP | 1970105 | A1 | 9/2008 |
| EP | 2024042 | B1 | 1/2010 |
| EP | 2198935 | A2 | 6/2010 |
| EP | 3050603 | A2 | 8/2016 |
| EP | 3050603 | B1 | 9/2018 |
| FR | 3044235 | A1 | 6/2017 |
| KR | 101989287 | B1 | 6/2019 |
| WO | 2006136727 | A2 | 12/2006 |
| WO | 2022106327 | A1 | 5/2022 |

* cited by examiner

POLE GRIP

BACKGROUND OF THE INVENTION

This invention is applicable to trekking poles, ski poles, and other like products. Such products have a grip at the top, to be gripped by the user. It is desirable for the user to be able to make a releasable connection between the grip and the user's glove or hand/wrist harness.

General Description

This invention is applicable to trekking poles, ski poles, and the like. Such poles have a grip fixed at the top end of the pole, for the user to grip onto the pole. Often the pole is configured to provide a releasable connection between the grip and the user's hand, via a strap or tether extending from a glove worn by the user. This connection can help the user to hold on to and maintain control of the pole during use.

In general terms, the present invention provides a connector assembly for making such a releasable connection. In general, and without limitation, embodiments of the connector assembly include two parts or elements fixed to the pole grip: a grip top or main body portion, which is fixedly secured to the pole itself, and a release button that is supported on the grip top for movement relative to the grip top. The connector assembly may also include a connector element that is connected with or secured to the user's hand, either directly on a glove or harness or by a strap or tether, to enable the aforesaid releasable connection between the glove and the pole. (The terms "tether" and "puck" are to be read broadly and may include, for example, various types of items and also to encompass directly sewing the item to the glove without a large distance between them, in addition to providing a length of material that does space the item from the glove.)

For reference, certain terms are used in this Description which are not to be considered as limiting for the claimed invention. Such terms include, without limitation, rearward, forward, laterally, and top (or above) and bottom (or below).

The devices illustrated in the drawings are physical embodiments only. Their construction (and the description of their construction) does not limit the scope of the invention.

Embodiments of the invention may include a pole including a pole grip on a shaft, and may include a connector assembly. The pole grip may be a molded plastic, foam, or cork element, glued onto or otherwise adhered to the pole shaft.

The connector assembly may include two parts or elements fixed to the pole: a grip top or main body portion, which may be fixedly secured to the pole, and a release button that may be supported on the grip top for movement relative to the grip top. The connector assembly may also include a connector element or puck that is connected with or secured to the user's hand, either directly on a glove or harness or by a strap or tether, to enable the aforesaid releasable connection between the glove and the pole.

The grip top may be a hollow part, preferably made from molded plastic, that is secured to the pole shaft. The grip top may have a flat outer edge surface that extends generally vertically and is presented forwardly toward and abuts the release button. A support pin, for supporting the release button, may be fixed in the interior of the grip top and extend laterally across the grip top. A compression spring or other type of spring or biasing member may be supported in the interior of the grip top and may extend generally vertically within the grip top.

Near its top, the grip top may have a locking channel or slot for receiving the puck. The slot may be bounded on its lower aspect by a ramp surface or sliding surface that extends rearward from the outer edge surface, in a direction away from the release button. This sliding surface, which may be generally planar, is bounded laterally by two slot walls.

The slot may have an open, relatively large, first end facing the release button, and an opposite, relatively small, second end at the outside of the grip top, farthest from the release button. The top of the slot may be open and define a passage or gap between the slot side walls. The two side walls of the slot may angle inward toward each other as they extend in a direction from the first end of the slot toward the second end of the slot. As a result, the slot may taper, that is, may be narrower at its smaller second end, opposite the release button.

The configuration of the slot may be dependent on, and track, the configuration of the puck. If the puck is a different shape from the one illustrated, then the slot may be a different shape. The particular shape and configuration of the puck and the slot as illustrated are simply one embodiment. For example, the puck and slot can be triangular, prismatic, block-shaped, etc.

In addition, the two side walls of the slot are preferably farther apart at their base, adjacent to the sliding surface, and closer together at their open top, with only the narrow passage at the top between them. The passage may be and is preferably wide enough to receive the tether, but narrower than the puck.

The release button may have an outer configuration that visually and tactilely completes the outer shape of the grip top. At its top the release button may have outer walls that extend upward past an upper surface or receiving surface of the button, forming a cavity. These walls may extend on three sides of the cavity, leaving an open end facing rearward toward the slot of the grip top.

The receiving surface of the release button may be generally planar, although it need not be, and may extend parallel to the sliding surface on the grip top. At the rearward end of the receiving surface, the release button may have a generally vertical blocking edge surface that faces the slot in the grip top. The blocking edge surface may be adjacent to the outer edge surface of the grip top, and may be slidable along that outer edge surface.

In some embodiments, including the illustrated embodiment, a magnet (or magnetic material) may be fixed in the release button, or may be provided as part or all of the release button (i.e., the release button may be partially or completely made of a magnetic material). A separate magnet may if desired be placed flush with or below or above the receiving surface. The magnet is not necessarily part of every pole that includes a connector assembly of the present invention. The magnet if present can provide additional utility, as described below. The magnet is preferably adjacent to or in front of the slot.

The release button may have a structural support portion that extends into the interior of the grip top. The support portion may have a generally vertical pin slot that receives the support pin of the grip top. The pin slot may extend in a direction parallel to the outer edge surface of the grip top. As a result, the release button may be supported on the grip top, by the support pin, for generally vertical sliding movement relative to the grip top, along the grip top outer edge surface.

The spring preferably acts between the release button and the grip top and biases the release button upward relative to the grip top, into a free state. When the release button is in its free state, the receiving surface of the release button may be parallel to but offset above the sliding surface of the grip top (where the two parts adjoin); the blocking edge surface on the release button may extend between those two surfaces. During movement of the release button relative to the grip top, the receiving surface on the release button would stay generally parallel to (but offset from) the sliding surface on the grip top.

The spring may be a compression spring. The return of the release button could be accomplished with other types of springs or biasing means. For example, a torsion spring, or a leaf spring, or a twist spring, or simply an elastomeric material.

The connector element may be configured to include a ferrous material that can be attracted by the magnet. The puck may include a plastic outer member, with a central steel rivet made of a ferrous material that can be attracted by the magnet on the release button. The puck may have tapered edges/sides to fit the slot side walls.

The puck may be conical in configuration, wider at the bottom, to fit closely in the slot and cooperate with the slot side walls and the sliding surface to retain the puck at the second end of the slot as desired. The dimensions of the puck are preferably selected so that the puck cannot pass through the narrow second end of the slot of the grip top, or through the gap at the top of the slot.

The puck may be connected via a tether to the user's glove. The tether may be optional in some embodiments, as the puck may be secured directly to the glove. Or a non-flexible tether may be used rather than a flexible cord as illustrated. This may be desirable if the puck were not round and needed to be held in a particular orientation of rotation relative to the slot.

If the connector assembly includes a magnet, as in the illustrated embodiment, and if the puck is made of or includes a ferrous material, again as illustrated, the puck can be attracted by the magnet on the button. The puck can be drawn out of the slot of the grip top into the cavity of the release button by this magnetic attraction, as soon as the release button is down. This action could be automatic, with no user effort needed for this movement to occur.

If the slot is open at both ends and also accessible from the top, the puck can clear out any debris or dirt or other unwanted material that might be in the slot.

In one embodiment, the invention relates to a pole configured to lockingly receive a connector member that is on a hand of a user of the pole, thereby to connect the pole to the user's hand, the pole comprising.

a grip top with a locking channel for lockingly receiving the connector member, the locking channel having a sliding surface and having a first end that is open;

a release button supported on the grip top adjacent to the locking channel, the release button being manually engageable by the user to move the release button relative to the locking channel from a locking position to a release position;

the release button having a blocking surface that closes the first end of the locking channel to prevent removal of the connector member from the locking channel when the release button is in the locking position; and the release button having a receiving surface for receiving the connector member in a receiving position adjacent to the locking channel when the release button is in the locking position, from which the connector member can be moved into the locking channel.

The release button may move from the locking position to the release position in response to movement of the connector member from the receiving surface of the release button to the sliding surface of the locking channel.

The release button may be manually movable from the locking position to the release position thereby to enable sliding movement of the connector member from the sliding surface of the locking channel onto the receiving surface of the release button.

A portion of the release button at the receiving surface may be magnetic and the connector member may include a ferrous material, the connector member moving from the locking channel onto the receiving surface at least partially in response to magnetic attraction of the connector member by the magnetic portion of the release button. The portion of the release button that is magnetic may be operable to assist in placing the connector member on the receiving surface in a position adjacent to the locking channel.

The release button may move out of the locking position toward the release position in response to sliding movement of the connector member from the receiving surface onto the locking channel.

The pole may include a tether connected to the connector member, the locking channel having a gap opposite its sliding surface for receiving the tether.

The locking channel may taper from its open end to a closed end blocking movement of the connector member out of the locking channel in a direction opposite the release button when the release button is in the locking position.

A pole may include a spring or other biasing means that acts between the grip top and the release button and that biases the release button into the locking position.

A connector member may be a puck having an outer shape that is configured to cooperate with the walls defining the locking channel thereby to assist in securing the puck in the locking channel.

The locking channel may be open at opposite ends to allow the connector member to clear material out of the locking channel in response to movement of the connector member into the locking channel.

The release button and connector member may be free of magnetic material.

The connector member may or may not tip as it is moved from the release button into the locking channel The invention also relates to a method of releasably connecting a user's glove to a pole. The glove may have a puck tethered to the glove, and the pole may have a grip top with a sliding surface for receiving the puck. The pole may also have a release button supported on the grip top for movement relative to the grip top between a locking position blocking removal of the puck from the grip top and a release position allowing removal of the puck from the grip top, the release button having a receiving surface for receiving the puck. The method may include the steps of:

placing the puck on the receiving surface of the release button when the release button is in the locking position;

sliding the puck from the receiving surface of the release button partially into the grip top and onto the sliding surface of the grip top;

engaging portions of the grip top with the puck to force the release button to move relative to the grip top toward the release position against a biasing force acting on the release button; and continuing to slide the puck from the receiving surface of the release button and completely onto the sliding surface of the grip top, thereby causing the release button to move relative to the grip top into the locking position under the influence of the biasing force.

After the puck is in the locking channel with the release button in the locking position, the method may include the further steps of manually moving the release button from the locking position to the release position and sliding the puck from the sliding surface of the locking channel onto the receiving surface of the release button, thereby enabling removal of the puck from the pole.

The puck may be of a ferrous construction, and the step of placing the puck on the receiving surface of the release button may include placing the puck on or adjacent to a magnetically attractive portion of the receiving surface When the puck is in the locking channel with the release button in the locking position, the method may include the further steps of manually moving the release button from the locking position to the release position and sliding the puck from the sliding surface of the locking channel onto the receiving surface of the release button, with the assistance of the magnetic attraction of the puck by the receiving surface.

BRIEF DESCRIPTION OF THE DRAWINGS

Further features of the invention will become apparent to one of ordinary skill in the art to which the invention pertains, from a reading of the following description together with the accompanying drawings, in which.

DESCRIPTION OF EMBODIMENTS

Figure 1:
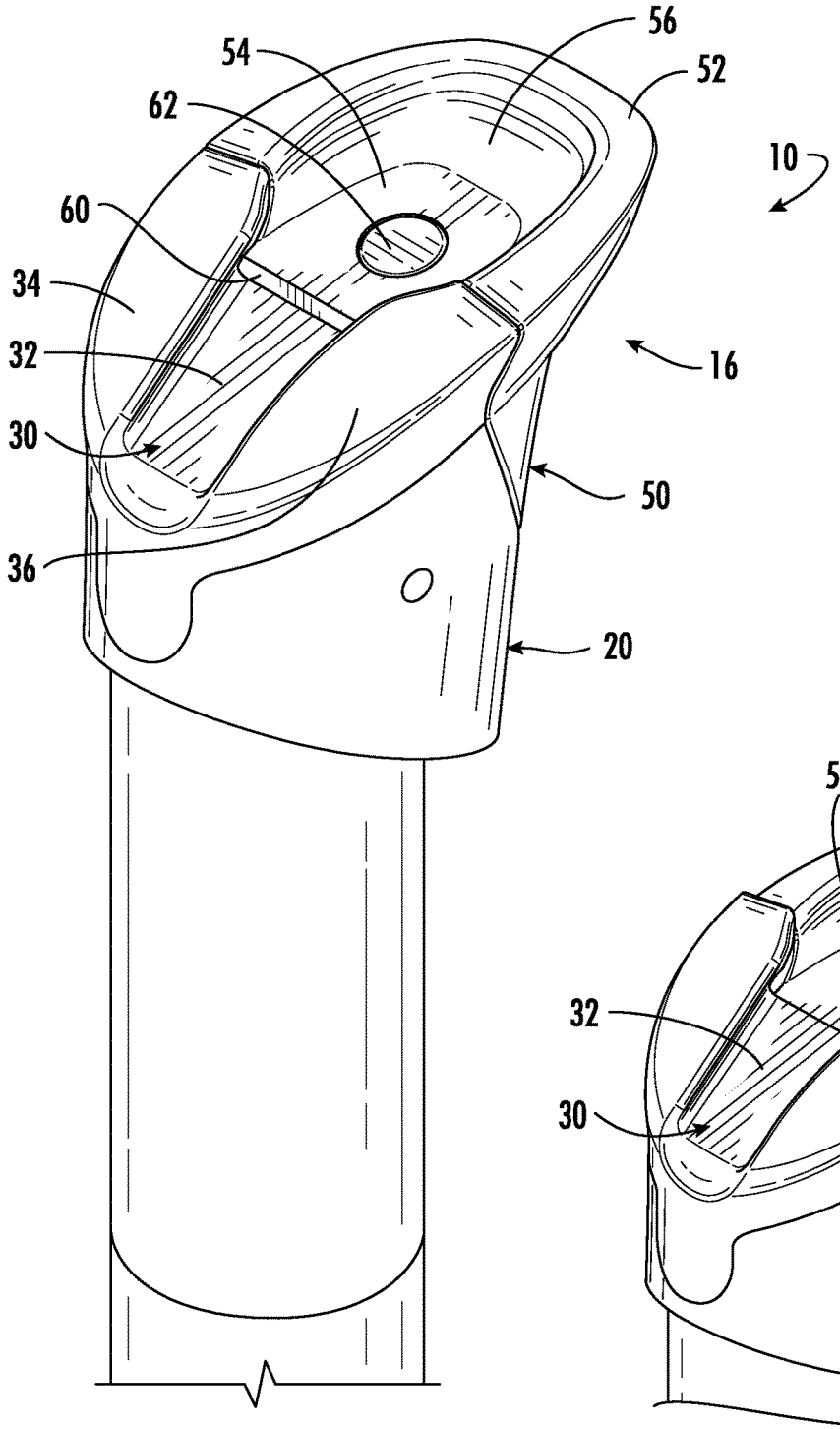
FIG. 1 is a perspective view of a portion of a trekking pole that includes a connector assembly that is a first embodiment of the invention including a grip top and a release button, the release button being shown in a locking position.
Figure 1A:
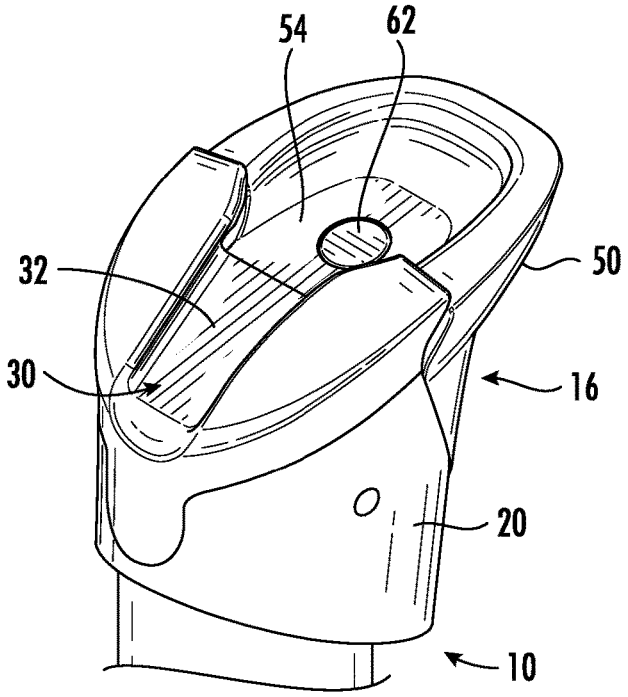
FIG. 1A is a partial perspective view similar to FIG. 1 but showing the release button pushed partially downward, to illustrate the alignment of a receiving surface of the release button with a sliding surface of the grip top.
Figure 2:
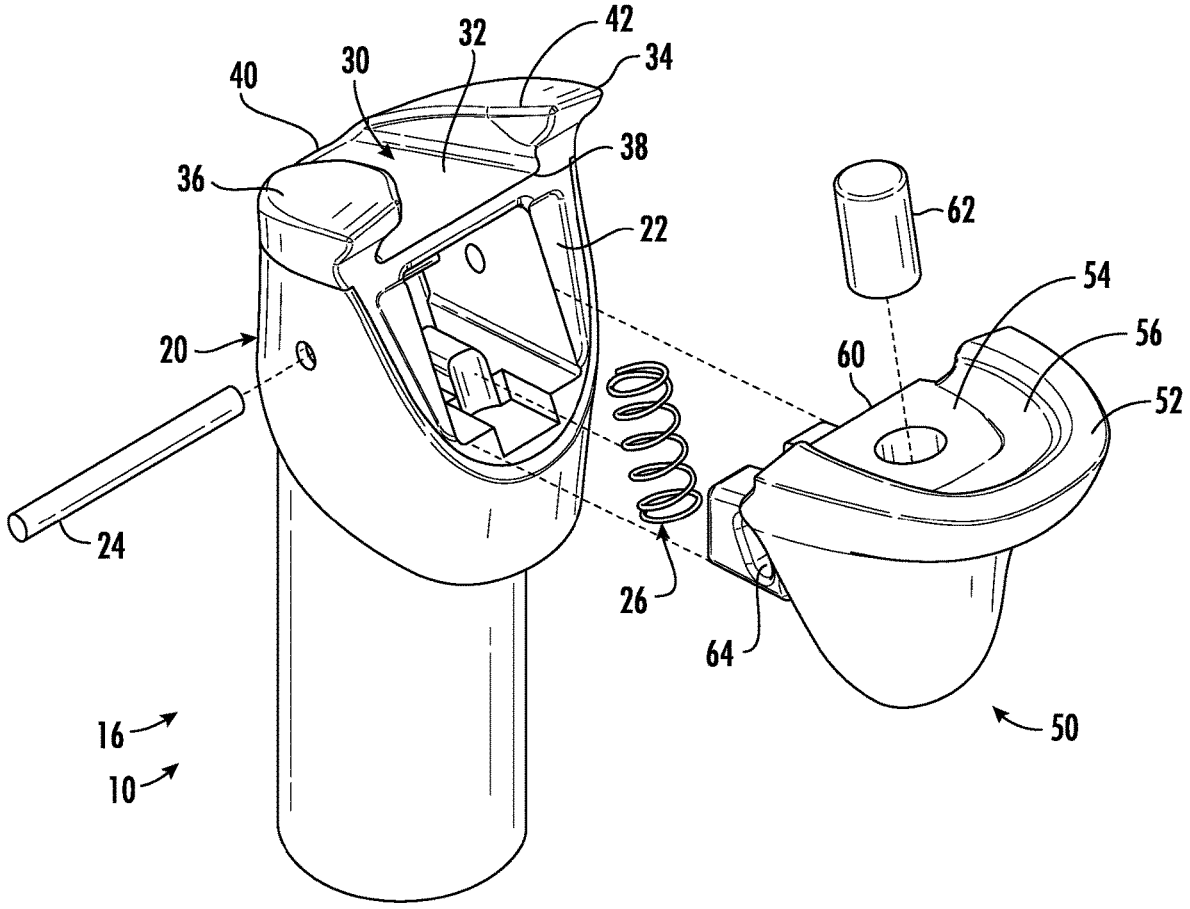
FIG. 2 is an exploded perspective view of parts of the connector assembly including the grip top and the release button.
Figure 3:
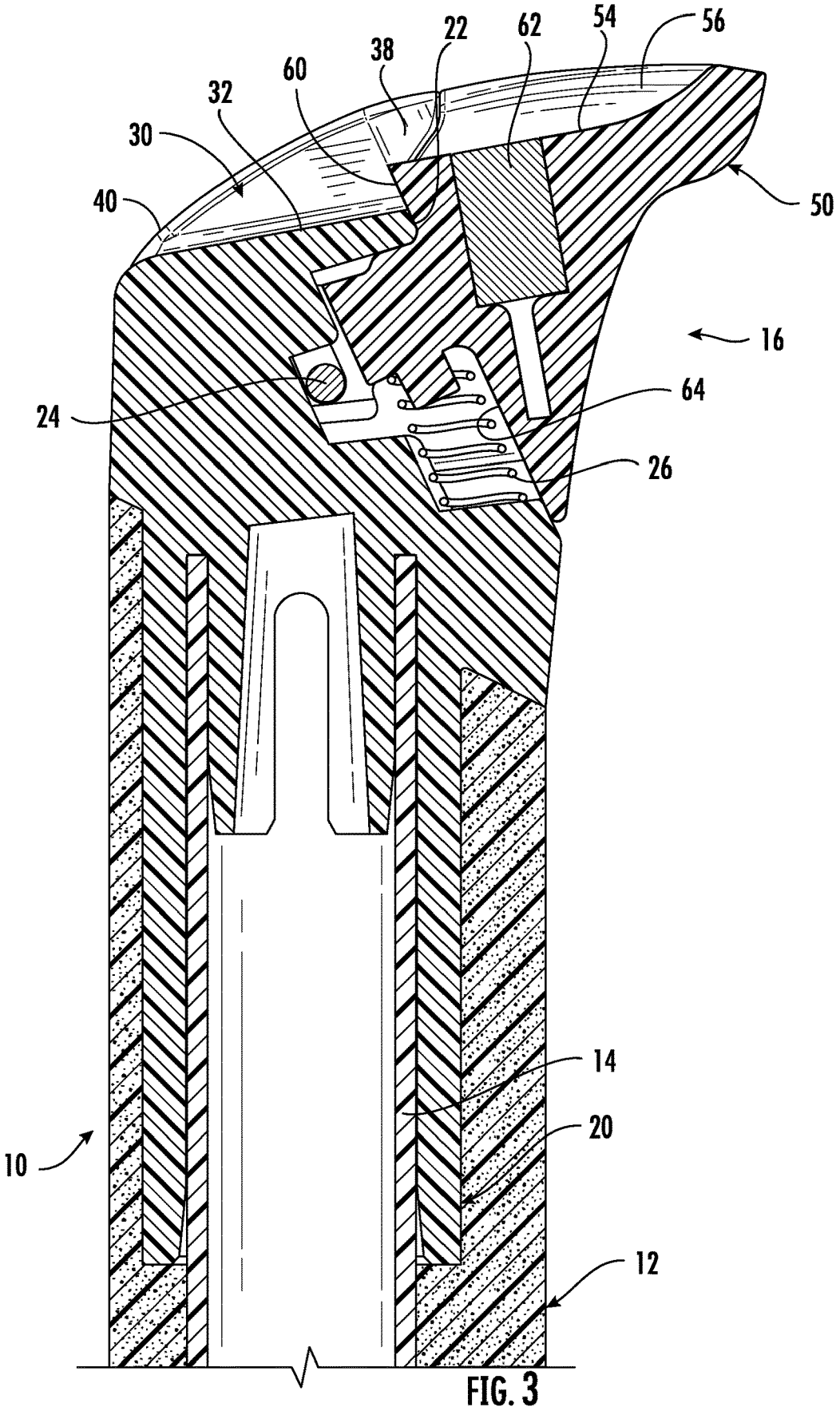
FIG. 3 is a sectional view of the pole, grip top, and release button, showing the release button in an upward, locking position and without the puck.
Figure 4:
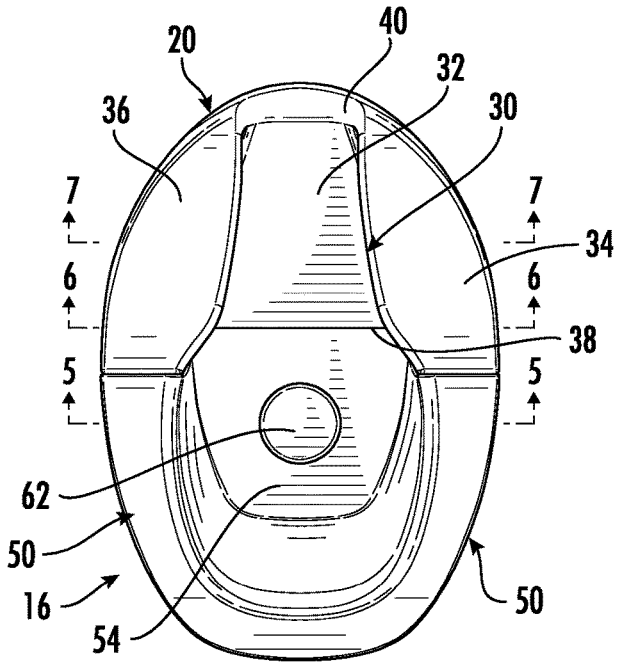
FIG. 4 is a top plan view of the connector assembly including the release button and the grip top.

This invention is applicable to trekking poles, ski poles, and the like. Such poles have a grip fixed at the top end of the pole, for the user to grip onto the pole. Often the pole is configured to provide a releasable connection between the grip and the user's hand, via a strap or tether extending from a glove worn by the user. This connection can help the user to hold on to and maintain control of the pole during use.

In general terms, the present invention provides a connector assembly for making such a releasable connection. In general, and without limitation, embodiments of the connector assembly include two parts or elements fixed to the pole grip: a grip top or main body portion, which is fixedly secured to the pole itself, and a release button that is supported on the grip top for movement relative to the grip top. The connector assembly also includes a connector element that is connected with or secured to the user's hand, either directly on a glove or harness or by a strap or tether, to enable the aforesaid releasable connection between the glove and the pole. (The terms "tether" and "puck" are to be read broadly and may, for example, encompass various types of items and also encompass directly sewing the item to the glove without a large distance between them, in addition to providing a length of material that does space the item from the glove.)

For reference, certain terms are used in this Description which are not to be considered as limiting for the claimed invention. Such terms include, without limitation, rearward, forward, laterally, and top (or above) and bottom (or below). Rearward means in a direction to the left as viewed in FIGS. 1-3 and 11-17, typically away from the user's hand and arm, and in a locking direction for the connector assembly. Forward is the opposite direction, to the right as viewed in FIGS. 1-3 and 11-17, toward the user's arm, a release direction of the connector assembly. Laterally means across from one side to the other, that is, transverse to the rearward and forward direction. Top means at or toward the top of the pole, where the grip is located; bottom or below means the opposite direction.

The drawings illustrate a pole 10 including a pole grip 12 on a shaft 14, and having a connector assembly 16 that is one embodiment of the invention. The specific construction of the pole grip 12 does not form part of the present invention. In the illustrated embodiment, the pole grip 12 is a molded foam element, glued onto or otherwise adhered to the pole shaft 14.

The illustrated connector assembly 16 includes two parts or elements fixed to the pole 10: a grip top or main body portion 20, which is fixedly secured to the pole 10, and a release button 50 that is supported on the grip top for movement relative to the grip top. The connector assembly 16 also includes a connector element or puck 70 (FIG. 10, described below in detail) that is connected with or secured to the user's hand, either directly on a glove or harness 72 or by a strap or tether 74, to enable the releasable connection between the glove and the pole 10.

The grip top 20 is a hollow part, preferably made from molded plastic, that is secured to the pole shaft 14. The grip top 20 has a flat outer edge surface 22 that extends generally vertically. This surface 22 is presented forwardly toward and abuts the release button 50. A support pin 24, for supporting the release button 50, is fixed in the interior of the grip top 20 and extends laterally across the grip top. A spring 26 is also supported in the interior of the grip top 20 and extends generally vertically within the grip top.

Near its top, the grip top 20 has a locking channel or slot 30 for receiving the puck 70. The slot 30 is bounded on its lower aspect by a ramp surface or sliding surface 32 that extends rearward from the outer edge surface 22, in a direction away from the release button 50. This sliding surface 32, which is generally planar, is bounded laterally by two slot walls 34 and 36.

Figure 5:
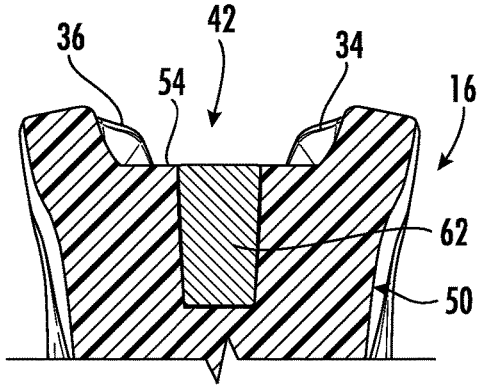
FIG. 5 is a partial sectional view taken along the line 5-5 of FIG. 4.
Figure 6:
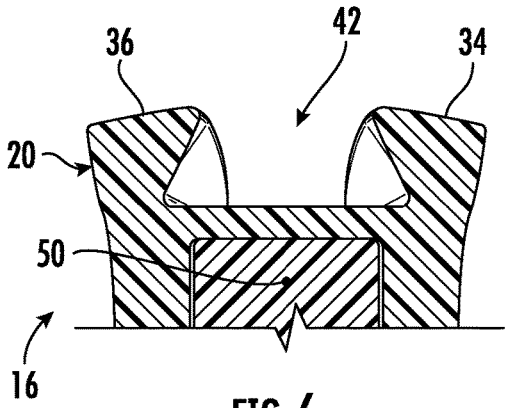
FIG. 6 is a partial sectional view taken along the line 6-6 of FIG. 4.
Figure 7:
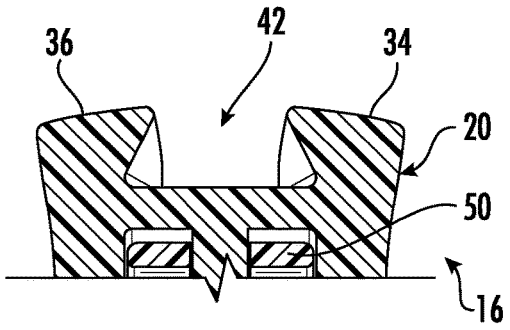
FIG. 7 is a partial sectional view taken along the line 7-7 of FIG. 4.
Figure 8:
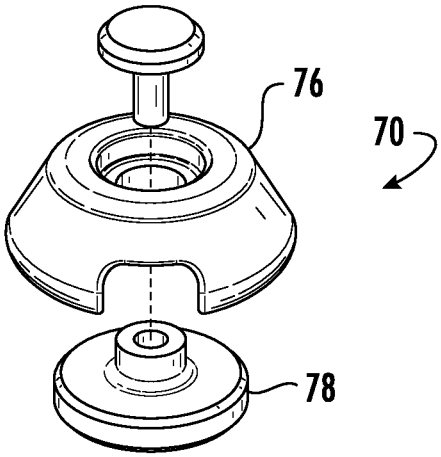
FIG. 8 is an exploded perspective view of a puck that forms part of the connector assembly.
Figure 9:
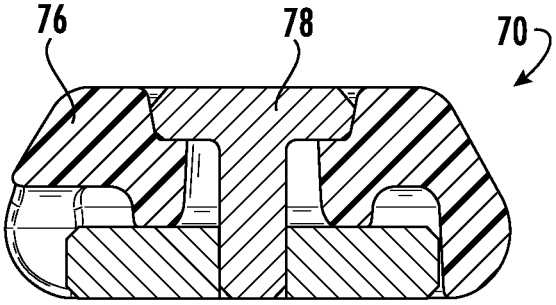
FIG. 9 is a sectional view of the puck.

The slot 30 has an open, relatively large, first end 38 facing the release button 50, and an opposite, relatively small, second end 40 at the outside of the grip top 20, farthest from the release button 50. The top of the slot 30 is open and defines a passage or gap 42 between the slot side walls 34 and 36. The two side walls 34 and 36 of the slot 30 angle inward toward each other as they extend in a direction from the first end 38 of the slot 30 toward the second end 40 of the slot 30. This is evident in a comparison of FIGS. 5, 6, and 7. As a result, the slot 30 tapers, that is, is narrower at its smaller second end 40, opposite the release button 50.

It should be noted that the configuration of the slot 30 is dependent on, and tracks, the configuration of the puck 70. If the puck 70 is a different shape, which is possible as noted below, then the slot 30 will be a different shape. The particular shape and configuration of the puck 70 and the slot 30 as illustrated are simply one embodiment. For example, the puck and slot can be triangular, prismatic, block-shaped, etc.

In addition, the two side walls 34 and 36 of the slot 30 are farther apart at their base, adjacent to the sliding surface 32, and closer together at their open top, with only the narrow passage 42 at the top between them. The passage 42 is wide enough to receive the tether 74, but narrower than the puck 70.

The release button 50 has an outer configuration that, preferably, visually and tactilely completes the outer shape of the grip top 20. At its top the release button 50 has outer walls 52 that extend upward past an upper surface or receiving surface 54 of the button, forming a cavity 56. These walls 54 extend on three sides of the cavity 56, leaving an open end facing rearward toward the slot 30 of the grip top 20.

The receiving surface 54 of the release button 50 is generally planar, although it need not be, and extends parallel to the sliding surface 32 on the grip top 20. At the rearward end of the receiving surface 54, the release button 50 has a generally vertical blocking edge surface 60 that faces the slot 30 in the grip top 20. The blocking edge surface 60 is adjacent to the outer edge surface 22 of the grip top 20, and is slidable along that outer edge surface.

In some embodiments, including the illustrated embodiment, a magnet (or magnetic material) is fixed in the release button 50, or is provided as part or all of the release button (i.e., the release button may be partially or completely made of a magnetic material). A magnet separate from the release button may if desired be placed flush with or slightly below the receiving surface 54, as indicated by the reference numeral 62. The magnet 62 is not necessarily part of every pole that might include a connector assembly of the present invention. The magnet 62, when present, does provide additional utility, as described below with reference to the operation of the illustrated embodiment. The magnet should be adjacent to or in front of the slot 30. In any of these cases, it is said that a portion of the release button is magnetic.

The release button 50 has a structural support portion that extends into the interior of the grip top 20. The support portion has a generally vertical pin slot 64 that receives the support pin 24 of the grip top 20. The pin slot 64 extends in a direction parallel to the outer edge surface 22 of the grip top 20. As a result, the release button 50 is supported on the grip top 20, by the support pin 24, for generally vertical sliding movement relative to the grip top, along the grip top outer edge surface 22.

The spring 26 acts between the release button 50 and the grip top 20. The spring 26 biases the release button 50 upward relative to the grip top 20, into a free state as illustrated in FIG. 1. When the release button 50 is in its free state, the receiving surface 54 of the release button 50 is parallel to but offset above the sliding surface 32 of the grip top 20 (where the two parts adjoin); the blocking edge surface 60 on the release button extends between and interconnects those two surfaces. During movement of the release button 50 relative to the grip top 20, the receiving surface 54 on the release button stays generally parallel to (but offset from) the sliding surface 32 on the grip top.

In the illustrated embodiment, the spring 26 is a compression spring. The return (biasing) of the release button 50 could be accomplished with other types of springs or biasing means. For example, a torsion spring, or a leaf sprint, or a twist spring, or simply an elastomeric material.

Figure 10:
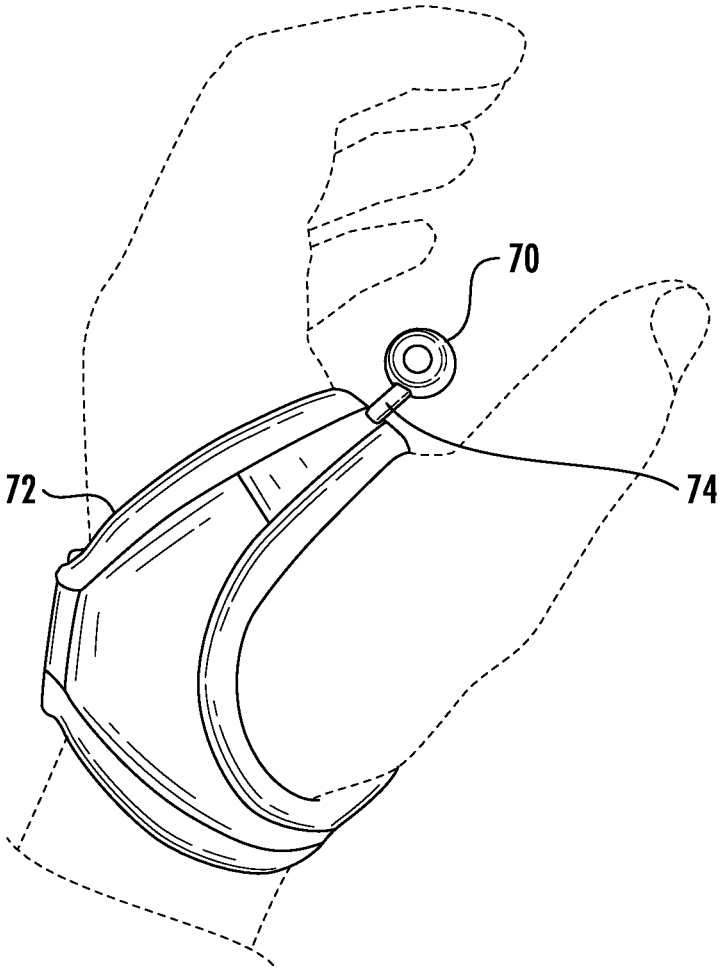
FIG. 10 is a pictorial view showing the puck attached by a tether to a glove on the hand of a user of the pole.
Figure 11:
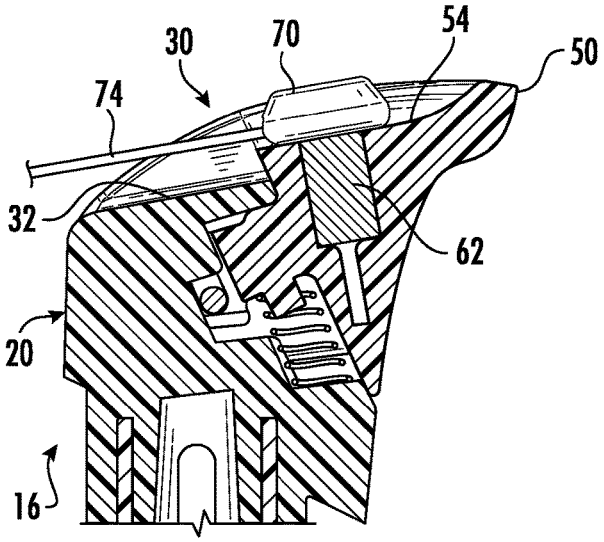
FIGS. 11-14 are a series of views illustrating the process of connecting the puck with the pole.
Figure 12:
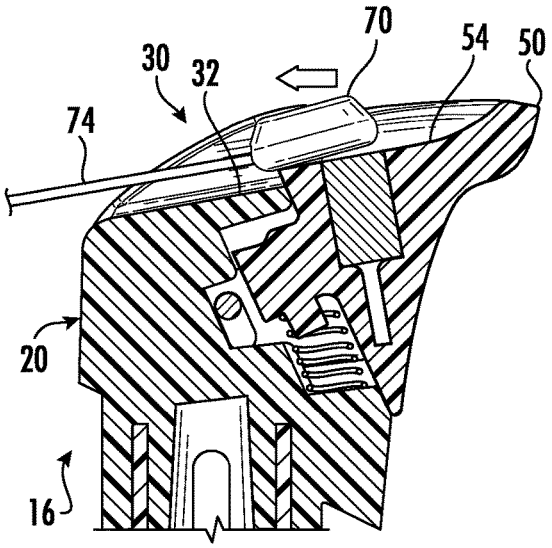
Figure 13:
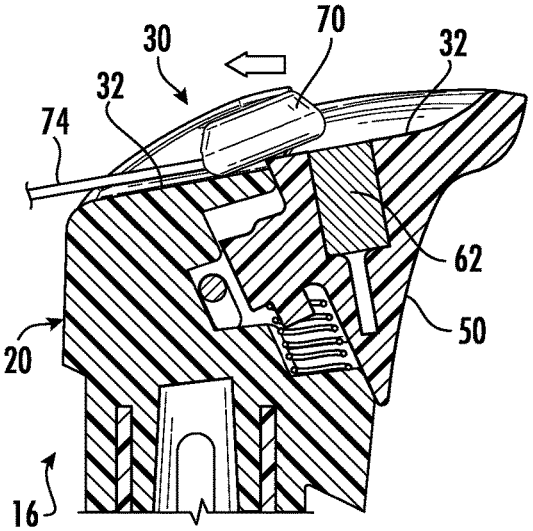
Figure 14:
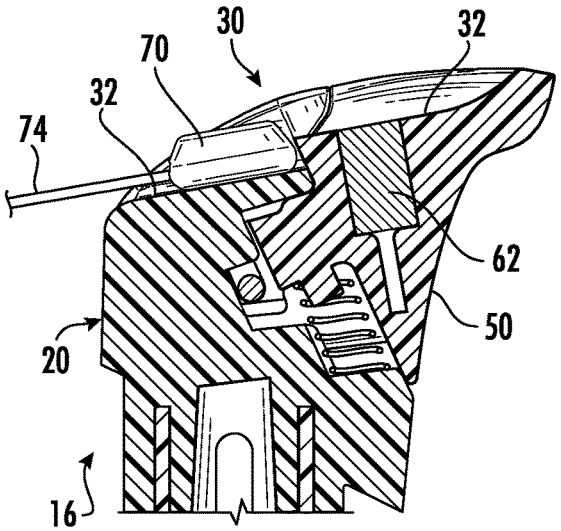
Figure 15:
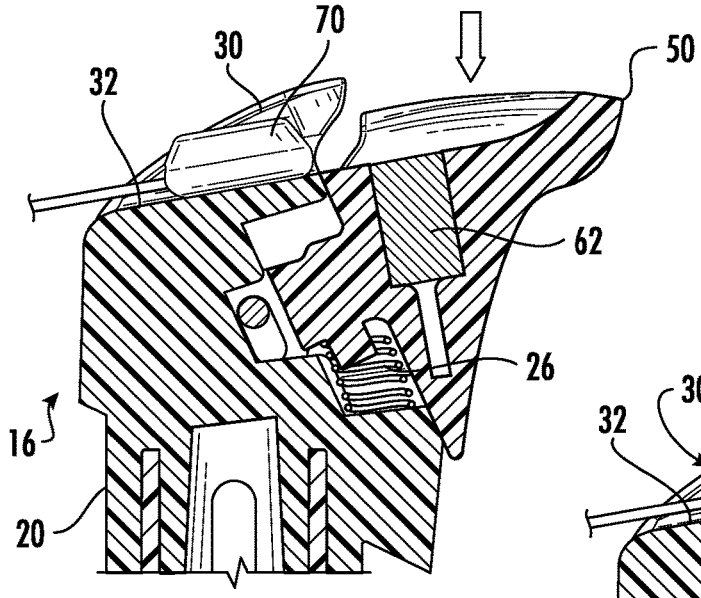
FIGS. 15-17 are a series of views illustrating the process of disconnecting the puck from the pole.
Figure 16:
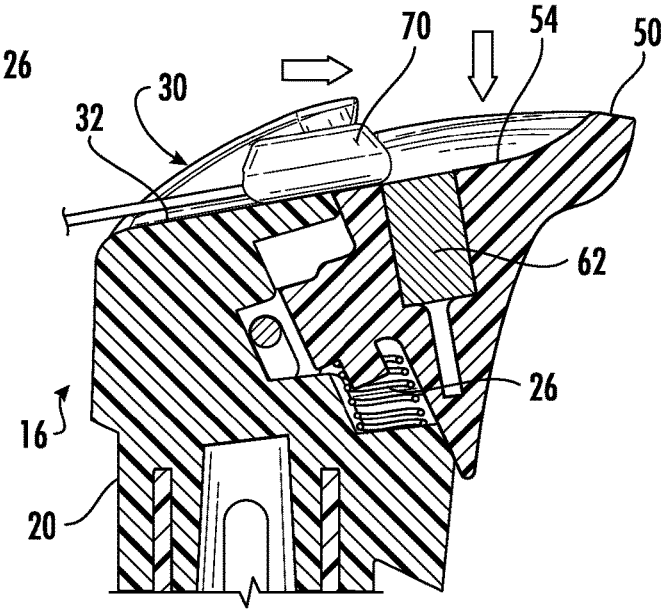
Figure 17:
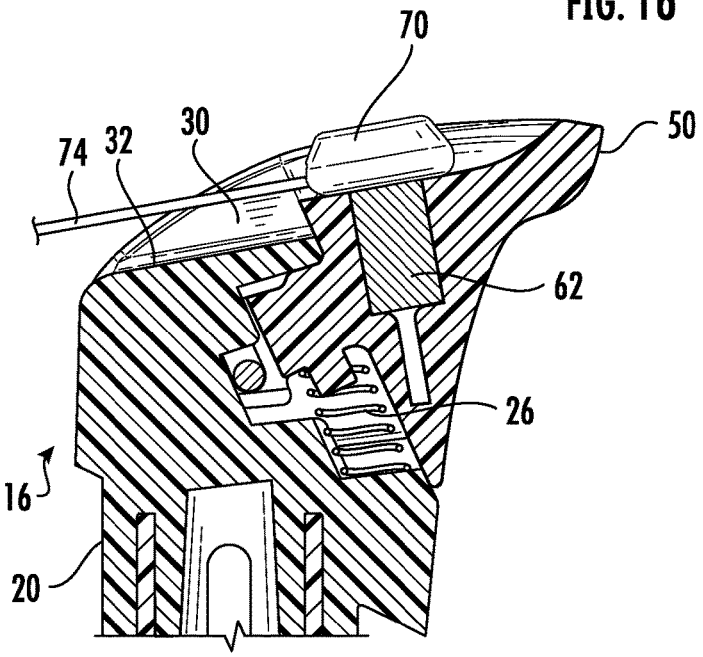

In the illustrated embodiment, the connector element 70 is configured to include a ferrous material that can be attracted by the magnet 62. One configuration of the puck 70 is as shown in FIGS. 10 and 11. Thus, the puck 70 includes a plastic outer member 76, with a central steel rivet 78. The rivet 78 is made of a ferrous material, and thus can be attracted by the magnet 62 on the release button 50. The puck 70 preferably has tapered edges/sides to fit the slot side walls 34 and 36. In other embodiments the rivet could be a screw, a bolt, or a pressed-in pin. Or, alternatively, the magnet can be in the puck and the ferrous part in or on the receiving surface.

The puck 70 may be conical in configuration, wider at the bottom, to fit closely in the slot 30 and cooperate with the slot side walls 34 and 36 and the sliding surface 32 to retain the puck at the second end 40 of the slot as desired. The dimensions of the puck 70 relative to the slot 30 are selected so that the puck cannot pass through the narrow second end 40 of the slot 30 of the grip top 20, or through the gap 42 at the top of the slot 30.

As noted, the puck 70 is connected via the tether 74 to the user's glove 72. The tether is optional in some embodiments, as the puck may be secured directly to the glove. Or a non-flexible tether may be used rather than the flexible string-like tether that is shown. This could be desirable if the puck were not round and needed to be held in a particular orientation of rotation relative to the slot.

To connect the pole with the glove, the user manually moves the puck 70 to a location adjacent the release button 50. This can be done, for example, by putting the user's hand (with the glove 72 on and the puck 70 attached) on the pole 10 in a normal gripping position. The user manually positions the puck 70 in the cavity 56 at the top of the release button 50, over and/or on the receiving surface 54. At this point in the process, the receiving surface 54 on the release button 50 is above the sliding surface 32 on the grip top 20, because of the biasing effect of the spring 26. The desired position for the puck 70 is preferably but not necessarily marked on the receiving surface 54.

If the connector assembly 16 includes a magnet and the puck includes a ferrous material, as in the illustrated embodiment, the magnet 62 can help to attract the puck 70 and place the puck into position selected to locate the puck accurately and correctly on the release button 50 so that it can be drawn easily and quickly into the slot 30 of the grip top 20.

Alternatively, the user can place the puck 70 in this starting position without assistance from the (or a) magnet. That is, the connector assembly 16 (release button 50, grip top 20, puck 70) is usable and workable, without magnetic assistance, to effect connection of the puck 70 with the grip top 20.

The user manually draws the puck 70 toward the grip top 20. This is done by moving the user's hand in the rearward direction, away from the release button 50, with the tether 74 fitting into the gap 42 at the top of the slot 30. The release button 50 does not need to be manually pushed down (against the spring 26 bias) during this insertion (connection, locking) process.

The user ensures that the tether 74 enters and passes through the gap 42 between the side two walls 34, 36 on the grip top 20. As the user moves the glove 72, the tether 74 pulls the puck 70 along the receiving surface 54 of the release button 50, in a direction out of the cavity 56 of the release button and toward and into the slot 30 of the grip top 20.

As the puck 70 is pulled (drawn) from the release button 50 toward and onto the grip top 20, the puck 70 engages the two angled slot walls 34, 36 on the grip top. The angled configuration of the slot walls 34, 36 may cause the puck 70 to tip, with its leading edge down, toward the sliding surface 32 of the grip top 20. As the puck 70 moves rearward, it is thus forced downward. The puck 70 gradually moves from the higher receiving surface 54 of the release button 50 onto the lower sliding surface 32 of the grip top 20.

The downward movement of the puck 70 causes the release button 50 itself to be displaced or pushed downward along and relative to the grip top 20, against the bias of the spring 26, because the puck 70 is still at least partially on the receiving surface 54 of the release button. The spring 26 compresses, allowing the release button 50 to move downward, with the pin slot 64 of the release button moving along the pin 24 of the grip top 20.

Thereafter, the leading edge of the puck 70 engages the sliding surface 32 of the grip top 20, and the puck 70 starts to slide rearward along the sliding surface. Once the puck 70 moves fully into the slot 30 in the grip top 20, off the release button 50, the slot walls 34, 36 cause the puck to lay flat along the sliding surface 32 of the slot.

At this point in the process, the puck 70 is no longer on (above) the release button 50, and is no longer forcing the release button downward. As a result, the release button 50 pops up, under the biasing force of the spring 26, returning to its free state. This movement of the release button 50 occurs automatically, without any further user intervention.

When the release button 50 pops up, its blocking edge surface 60, facing the slot 30, again extends upward past the sliding surface 32 of the slot. The blocking edge surface 60 of the release button 50 blocks movement of the puck 70 out of the slot 30 of the grip top 20. Thus, the puck 70 cannot move forwardly out of the slot 30. The slot walls 34, 36 block movement of the puck 70 out of the small opening at the second end 40 of the slot 30. In addition, the puck 70 is captured laterally between the side walls 34, 36 of the slot 30, and vertically between the grip top sliding surface 32 and the inwardly extending side walls.

As a result, the puck 70 is securely captured (trapped) in the slot 30 of the grip top 20, establishing the desired secure force-transmitting connection (via the tether 74) between the pole 10 and the user's hand. Specifically, the puck 70 is engaged on three sides (side walls 34 and 36 and sliding surface 32) by the grip top 20 and on one side by the release button 50. The puck 70 is, as a practical matter, immovable from the grip top.

To release the connection, the user manually pushes down on the release button 50, against the bias of the spring 26. The release button 50 slides down along the grip top 20. As this sliding movement occurs, the blocking edge surface 60 on the release button 50 moves downward along the outer edge surface 22 of the grip top 20, and the blocking edge surface 60 no longer blocks movement of the puck 70 out of the slot 30. Simultaneously, the receiving surface 54 of the release button 50 lines up with (becomes coplanar with) the sliding surface 32 of the grip top 20. As a result, the puck 70 is free to slide out of the slot 30 into the cavity 56 of the release button 50.

The user can manually draw the puck 70 forward, out of the slot 30 and onto the release button 50. When this movement occurs, the puck 70 moves free of the slot walls 34, 36.

If the connector assembly 16 includes a magnet 62, as in the illustrated embodiment, and if the puck 70 is made of or includes a ferrous material, again as illustrated, the puck is attracted by the magnet on the button. The puck 70 is drawn out of the slot 30 of the grip top 20 into the cavity 56 of the release button 50 by this magnetic attraction, as soon as the release button 50 is down. This action is automatic; no user effort is needed for this movement to occur.

Once the puck 70 is on the release button 50 and no longer on the grip top 20, the puck 70 can be lifted off the pole 10. The user's hand is no longer connected with the pole 10. The release button 50 can be released, and pops up again to its free state.

A benefit of the design of the slot 30 is that it is open at both ends and also accessible from the top. Thus, as the puck enters the slot, the puck can clear out any debris or dirt or other unwanted material that might be in the slot. This is in contrast to a slot or opening in the side of a pole or pole grip, which is accessible from one side only, the entrance and exit opening for the connector member.

It should be understood that, in the context of this disclosure, a recitation of a series of elements means any one of the elements in the series or any combination of the elements in the series, including all of the elements. So, for example, a recitation of "at least one of A, B, or C", or of "A and B and C" means any of A, B, C, A+B, A+C, B+C, or A+B+C. Further, the fact that an illustrated embodiment includes several features or elements does not mean that, to be covered by the claims, an embodiment needs to have all of those features. Other embodiments with subsets of features are included within the scope of the invention.

Although the invention has been described in terms of particular embodiments and applications, one of ordinary skill in the art, in light of this teaching, can generate additional embodiments and modifications without departing from the spirit of or exceeding the scope of the claimed invention. Accordingly, the scope of the invention is limited only by the claims.

The invention claimed is:

1. A pole configured to lockingly receive a connector member that is on a hand of a user of the pole, thereby to connect the pole to the user's hand, said pole comprising:

a grip top with a locking channel for lockingly receiving the connector member, the locking channel having a sliding surface and having a first end that is open;

a release button supported on the grip top adjacent to the locking channel, the release button being manually engageable by the user to move the release button relative to the locking channel from a locking position to a release position;

the release button having a blocking surface that closes the first end of the locking channel to prevent removal of the connector member from the locking channel when the release button is in the locking position; and the release button having a receiving surface for receiving the connector member in a receiving position adjacent to the locking channel when the release button is in the locking position, from which the connector member can be moved into the locking channel, the release button moving from the locking position to the release position in response to movement of the connector member from the receiving surface of the release button to the sliding surface of the locking channel;

wherein a portion of the release button at the receiving surface is magnetic and the connector member includes a ferrous material, the connector member moving from the locking channel onto the receiving surface at least partially in response to magnetic attraction of the connector member by the magnetic portion of the release button receiving surface.

2. A pole as set forth in claim 1 wherein the portion of the release button receiving surface that is magnetic is operable to assist in placing the connector member on the receiving surface in position to be moved into the locking channel.

3. A pole as set forth in claim 2 wherein the release button moves out of the locking position toward the release position in response to sliding movement of the connector member from the receiving surface onto the locking channel.

4. A pole configured to lockingly receive a connector member that is on a hand of a user of the pole, thereby to connect the pole to the user's hand, said pole comprising:

a grip top with a locking channel for lockingly receiving the connector member, the locking channel having a sliding surface and having a first end that is open;

a release button supported on the grip top adjacent to the locking channel, the release button being manually engageable by the user to move the release button relative to the locking channel from a locking position to a release position;

the release button having a blocking surface that closes the first end of the locking channel to prevent removal of the connector member from the locking channel when the release button is in the locking position; and the release button having a receiving surface for receiving the connector member in a receiving position adjacent to the locking channel when the release button is in the locking position, from which the connector member can be moved into the locking channel;

wherein the release button is manually movable from the locking position to the release position thereby to enable sliding movement of the connector member from the sliding surface of the locking channel onto the receiving surface of the release button; and wherein a portion of the release button at the receiving surface is magnetic and the connector member includes a ferrous material, the connector member moving from the locking channel onto the receiving surface at least partially in response to magnetic attraction of the connector member by the magnetic portion of the release button.

5. A pole as set forth in claim 4 wherein the portion of the release button that is magnetic is operable to assist in placing the connector member on the receiving surface in a position adjacent to the locking channel.

6. A method of releasably connecting a user's glove to a pole, the glove having a puck tethered to the glove, the pole having a grip top with a sliding surface for receiving the puck, the pole also having a release button supported on the grip top for movement relative to the grip top between a locking position blocking removal of the puck from the grip to and a release position allowing removal of the puck from the grip top, the release button having a receiving surface for receiving the puck;

the method comprising the steps of:

placing the puck on the receiving surface of the release button when the release button is in the locking position;

sliding the puck from the receiving surface of the release button partially into the grip top and onto the sliding surface of the grip top;

said sliding step including the step of engaging portions of the grip top with the puck to force the release button to move relative to the grip top toward the release position against a biasing force acting on the release button;

continuing to slide the puck from the receiving surface of the release button and completely onto the sliding surface of the grip top, thereby causing the release button to move relative to the grip top into the locking position under the influence of the biasing force;

wherein the puck is of a ferrous construction;

the step of placing the puck on the receiving surface of the release button includes placing the puck on or adjacent to a magnetically attractive portion of the receiving surface; and when the puck is in the locking channel with the release button in the locking position, including the further steps of manually moving the release button from the locking position to the release position and sliding the puck from the sliding surface of the locking channel onto the receiving surface of the release button, with the assistance of the magnetic attraction of the puck by the receiving surface.

* * * * *